US010689146B2

(12) United States Patent
Hugley

(10) Patent No.: US 10,689,146 B2
(45) Date of Patent: Jun. 23, 2020

(54) ORIENTAL FOOD TAKEOUT BOX AND PLATE ASSEMBLY

(71) Applicant: Chadrick Deon Hugley, Fort Lauderdale, FL (US)

(72) Inventor: Chadrick Deon Hugley, Fort Lauderdale, FL (US)

( * ) Notice: Subject to any disclaimer, the term of this patent is extended or adjusted under 35 U.S.C. 154(b) by 0 days.

(21) Appl. No.: 16/022,441

(22) Filed: Jun. 28, 2018

(65) Prior Publication Data

US 2019/0002154 A1 Jan. 3, 2019

Related U.S. Application Data

(60) Provisional application No. 62/526,320, filed on Jun. 28, 2017.

(51) Int. Cl.

| | |
|---|---|
| ***B65D 5/02*** | (2006.01) |
| ***B65D 81/36*** | (2006.01) |
| ***B65D 5/50*** | (2006.01) |
| ***B65D 77/04*** | (2006.01) |
| ***B65D 5/66*** | (2006.01) |
| ***B65D 5/24*** | (2006.01) |
| ***B65D 77/24*** | (2006.01) |

(52) U.S. Cl.

CPC ..... *B65D 5/0254* (2013.01); *B65D 5/241* (2013.01); *B65D 5/5021* (2013.01); *B65D 5/6673* (2013.01); *B65D 77/0413* (2013.01); *B65D 77/245* (2013.01); *B65D 81/36* (2013.01); *B65D 2577/042* (2013.01)

(58) Field of Classification Search

CPC .... B65D 5/0254; B65D 5/241; B65D 5/5021; B65D 5/6673; B65D 77/0413; B65D 77/245; B65D 81/36; A47G 2021/002

USPC ..... 229/153, 906, 103, 401, 902, 904, 229/117.18; 220/735, 574.1, 556; D7/653; 206/541; D9/717

See application file for complete search history.

(56) References Cited

U.S. PATENT DOCUMENTS 3,704,779 A * 12/1972 Nigg ..... A47G 19/06 220/556
4,572,423 A * 2/1986 Spencer ..... B65D 5/0015 206/509
4,684,023 A * 8/1987 Cortopassi ..... B65D 5/4216 206/459.1

(Continued)

*Primary Examiner* — Christopher R Demeree
(74) *Attorney, Agent, or Firm* — Mark C. Johnson; Johnson Dalal

(57) ABSTRACT

An oriental food takeout box and plate assembly and method of folding provides a unitary body, which is interchangeable between a planar eating surface configuration and a takeout box configuration along a folding and unfolding path. The takeout box configuration is defined by two opposing side faces with each side face forming at least one side container aperture, two opposing lateral faces, an enclosed bottom face, an inner upper face opposing the enclosed bottom face and defining two parallel spaced-apart slits forming a loop, and an outer upper face defining a loop aperture with the loop protruding therethrough. At least one utensil passes through the loop to fasten the outer upper face to inner upper face, so as to retain the unitary body in the takeout box configuration. Side container apertures form in the side faces to retain side containers that contains a condiment for consuming with the oriental food.

20 Claims, 9 Drawing Sheets

(56) References Cited

U.S. PATENT DOCUMENTS

| | | | | | |
|---|---|---|---|---|---|
| 5,014,853 | A * | 5/1991 | Crockett | A47G 21/001 | 229/103 |
| 5,411,204 | A * | 5/1995 | DeMay | B65D 5/2047 | 229/114 |
| 5,423,478 | A * | 6/1995 | Roosa | B65D 5/46104 | 229/114 |
| 5,873,220 | A * | 2/1999 | Haraldsson | B65D 5/2047 | 229/186 |
| 9,309,023 | B2 * | 4/2016 | Hubbard, Jr. | B65D 5/2076 | |
| 2013/0334234 | A1 * | 12/2013 | Vernon | B65D 25/00 | 220/600 |
| 2015/0014329 | A1 * | 1/2015 | Konopatsky | A47G 21/06 | 220/574 |

* cited by examiner

ORIENTAL FOOD TAKEOUT BOX AND PLATE ASSEMBLY

CROSS-REFERENCE TO RELATED APPLICATION

This application claims priority to U.S. Provisional Patent Application No. 62/526,320 filed Jun. 28, 2017, the entirety of which is incorporated by reference.

FIELD OF THE INVENTION

The present invention relates generally to portable food containers and, more specifically to, oriental food takeout containers.

BACKGROUND OF THE INVENTION

Typically, take-out food is packaged in paper, paperboard, corrugated fiberboard, plastic, or foam food containers. The takeout container is primarily configured to contain and carry prepared meals or other food items, purchased at a restaurant that the purchaser intends to eat elsewhere. One commonly known takeout container, the Chinese oyster takeout box, is a folded, waxed or plastic coated, paperboard container. Such takeout boxes have an elongated rectangular shape and include a wire handle. Often, the Chinese oyster takeout box is coated with a material such as wax or plastic. The paraffin-based wax or plastic coating on such containers hinders their recyclability. This makes it unsuitable for consuming the food contained therein.

In many instances, the chopsticks, or other utensils, necessary to consume the food are not attached to the Chinese oyster takeout box. Similarly, condiments are generally not attached to, or placed inside the Chinese oyster takeout box. This results in a situation where the required utensil and condiments are not provided, either because the food packager forgot, or the condiment and utensil became separated from the Chinese oyster takeout box during the food packaging and pickup process.

Therefore, a need exists to overcome the problems with the prior art as discussed above.

SUMMARY OF THE INVENTION

The invention provides an oriental food takeout box and plate assembly and method for folding an oriental food takeout box and plate assembly between a takeout box configuration and a substantially planar eating surface configuration that overcomes the hereinafore-mentioned disadvantages of the heretofore-known devices and methods of this general type and that provides a unitary body, which is interchangeable along a folding and unfolding path between a takeout box configuration for containing and handling oriental food, and a planar eating surface configuration for providing a surface to consume the oriental food.

The takeout box and plate assembly overcomes known disadvantages of those known devices and methods of this general type and effectively and efficiently stores and transports editable items such as oriental food. Specifically, one principal objective of the present invention is to create a takeout box that makes carrying the sushi, condiments, e.g., soy sauce, and utensils, e.g., chopsticks, easier and more economical; and then follows a simple unfolding path to transform into a plate, from which the oriental food can be consumed upon, accessed with the utensil, and immersed in the condiment in the side container.

With the foregoing and other objects in view, there is provided, in accordance with the invention, an oriental food takeout box and plate assembly, comprising a unitary body being interchangeable between a takeout box configuration for containing and handling oriental food, and a planar eating surface configuration for providing a surface to consume the oriental food.

The takeout box configuration is defined by an inner surface defining a cavity, and an outer surface. The takeout box configuration is further defined by two opposing side faces with each side face forming at least one side container aperture, two opposing lateral faces, an enclosed bottom face, an inner upper face opposing the enclosed bottom face and defining two parallel spaced-apart slits forming a loop, and an outer upper face defining and enclosing a loop aperture with the loop protruding therethrough.

In some embodiments, at least one utensil is disposed through the loop that forms in the outer upper face, and directly coupled to the outer surface of the unitary body. The utensil serves the dual purpose of fastening the outer upper face to the inner upper face, so as to retain the unitary body in the takeout box configuration, and providing a means to consume the oriental food. At least one side container aperture forms in the side faces. The side container aperture serves to retain at least one side container that contains a condiment for flavoring the oriental food.

In the eating surface configuration, the inner surface of the unitary body is configured to support food for consumption. Thus, the eating surface configuration of the unitary body serves as a plate for oriental food. Further, the oriental food may be accessed with the utensil and dipped in the condiments contained in the removable side containers.

In accordance with another feature of the present invention, the assembly further includes at least one side container tapering in diameter to a distal end, the distal end of the side container disposed through the side container aperture and retained by and coupled to each respective side face.

In accordance with another feature of the present invention, the assembly further includes two tabs extending from the two opposing side faces.

In accordance with a further feature of the present invention, the tabs fold to position between the lateral faces and the inner upper face when in the takeout box configuration.

In accordance with a further feature of the present invention, the inner upper face is disposed parallel to the outer upper face.

In accordance with a further feature of the present invention, the inner upper face is disposed more proximal to the bottom face than the outer upper face.

In accordance with a further feature of the present invention, the side container aperture is defined by a circular shape.

In accordance with a further feature of the present invention, the loop aperture is defined by a rectangular shape.

In accordance with a further feature of the present invention, the takeout box configuration comprises a box having an oblong shape.

In accordance with a further feature of the present invention, the assembly further includes a first pair of interconnecting wings disposed between the side faces and the inner upper face.

In accordance with a further feature of the present invention, the assembly further includes a second pair of interconnecting wings disposed between the side faces and one of the lateral faces.

In accordance with a further feature of the present invention, the interconnecting wings are defined by an arc shape.

In accordance with a further feature of the present invention, the interconnecting wings fold in half when in the takeout box configuration.

In accordance with a further feature of the present invention, the at least one utensil comprises a chopstick.

In accordance with a further feature of the present invention, at least one perforated line being disposed between the faces.

In accordance with the present invention, a method for folding an oriental food takeout box and plate assembly between a takeout box configuration and a substantially planar eating surface configuration. The method may include an initial Step of providing a unitary body being interchangeable between a planar eating surface configuration and a takeout box configuration, the takeout box configuration defined by two opposing side faces with each side face having a tab extending therefrom and forming at least one side container aperture retaining at least one side container, two opposing lateral faces, an enclosed bottom face, an inner upper face opposing the enclosed bottom face and defining two parallel spaced-apart slits forming a loop.

The method may further comprise a Step of providing at least one utensil disposed through the loop, the utensil fastening the outer upper face to the inner upper face, whereby the utensil retains the unitary body in the takeout box configuration.

A Step includes slidably removing the at least one utensil from the loop.

In some embodiments, a Step comprises disengaging the outer upper face from the inner upper face.

A Step includes disengaging the tab from between the lateral faces and the inner upper face.

In some embodiments, a Step may include folding the side faces outwardly until planar with the bottom face.

A Step comprises folding the lateral faces outwardly until planar with the bottom face.

In some embodiments, a Step may include folding the inner and outer upper faces outwardly until planar with the lateral faces, whereby the planar eating surface configuration is formed.

A Step comprises accessing oriental food from the planar faces with the at least one utensil.

A final Step includes dipping the oriental food in the at least one side container disposed in the at least one side container aperture.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

One objective of the present invention is to create a takeout box that makes carrying the condiments, e.g., soy sauce, and utensils, e.g., chopsticks, easier and more economical takeout box.

Another objective of the present invention is to provide an easy unfolding path to transform the unitary body from the takeout box configuration to the planar eating surface configuration.

Another objective of the present invention is to provide tabs that securely fasten the unitary body in the takeout box configuration.

Another objective of the present invention is to provide perforated lines across the surface of the unitary body to enable guidance for following the unfolding path; create a visual guide to help in following the unfolding path; and form a weak point that facilitates folding and unfolding the faces to the desired configuration.

Another objective of the present invention is to provide at least one utensil that has the dual purpose of fastening the unitary body in the takeout box configuration, and accessing the oriental food from the faces in the planar eating surface configuration.

Another objective of the present invention is to provide two detachable side containers in the side faces of the unitary body for filling with a condiment.

Yet another objective of the present invention is to provide perforated lines between the faces to facilitate folding along the unfolding path and to provide interconnecting wings between the faces to create greater structural integrity between the faces in the takeout box configuration.

Yet another objective of the present invention is to enable the interconnecting wings to fold and to provide a disposable, lightweight takeout box for oriental food.

Although the invention is illustrated and described herein as embodied in an Oriental Food Takeout Box and Plate Assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the unitary body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
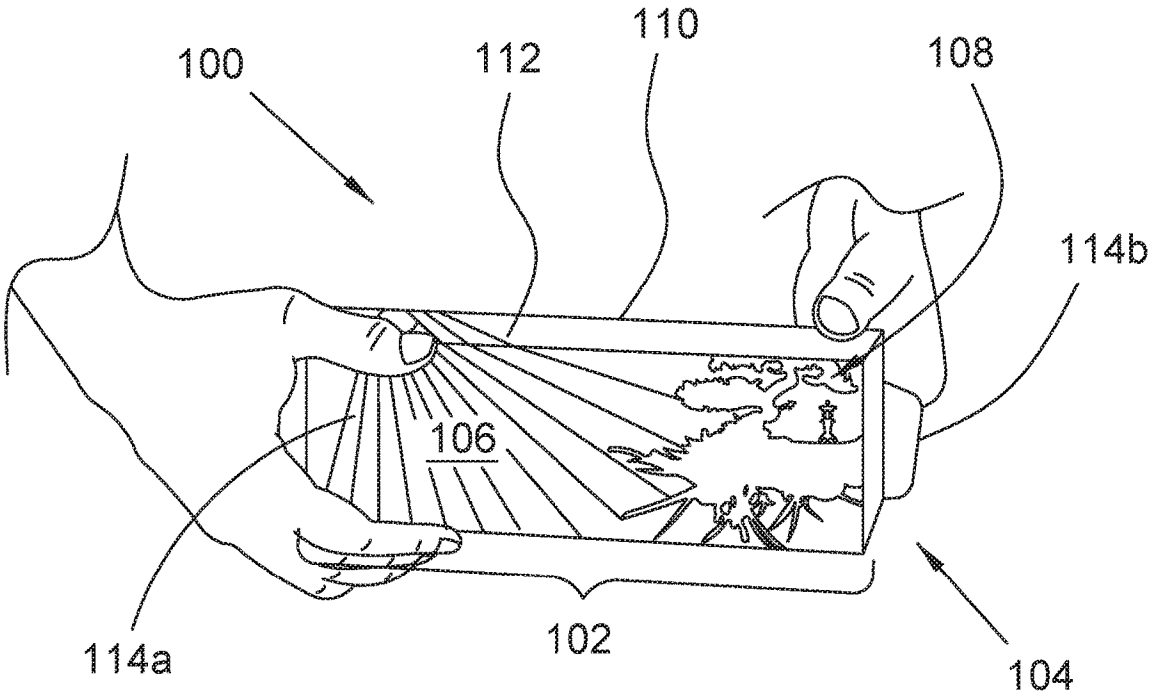
FIG. 1 is a perspective view of an exemplary oriental food takeout box and plate assembly being handled while containing oriental food, in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The invention described herein provides an oriental food takeout box and plate assembly 100 method 800 for folding an oriental food takeout box and plate assembly between a takeout box configuration and a substantially planar eating surface configuration, which overcomes known disadvantages of those known devices and methods of this general type and that effectively and efficiently stores and transports editable items, such as oriental food. Specifically, one principal objective of the present invention is to create a takeout box that makes carrying the oriental food, sushi, condiments, e.g., soy sauce, and utensils, e.g., chopsticks, easier and more economical. Although the invention is illustrated and described herein as embodied in an oriental food takeout box and plate assembly 100, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

It is to be understood that the disclosed embodiments herein are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

The attached figures are incorporated in and form part of the specification, and serve to further illustrate various embodiments and explain various principles and advantages all in accordance with the present invention. Moreover, it is believed that the invention will be better understood from a consideration of the following description in conjunction with the drawing figures, in which like reference numerals are carried forward.

Figure 6:
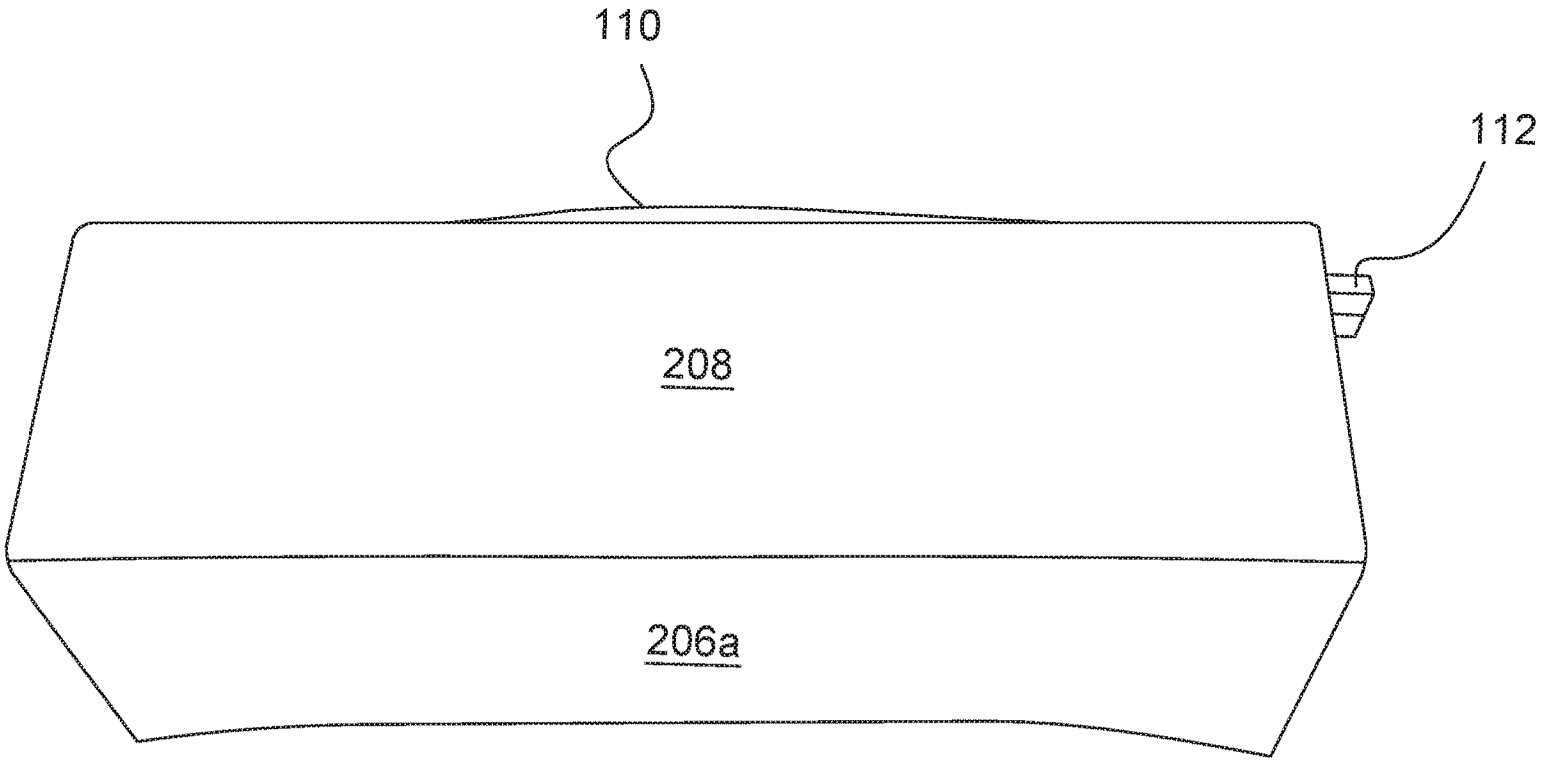
FIG. 6 is a perspective view of the takeout box configuration, showing the lateral face and the bottom face adjoined, in accordance with the present invention.
Figure 7:
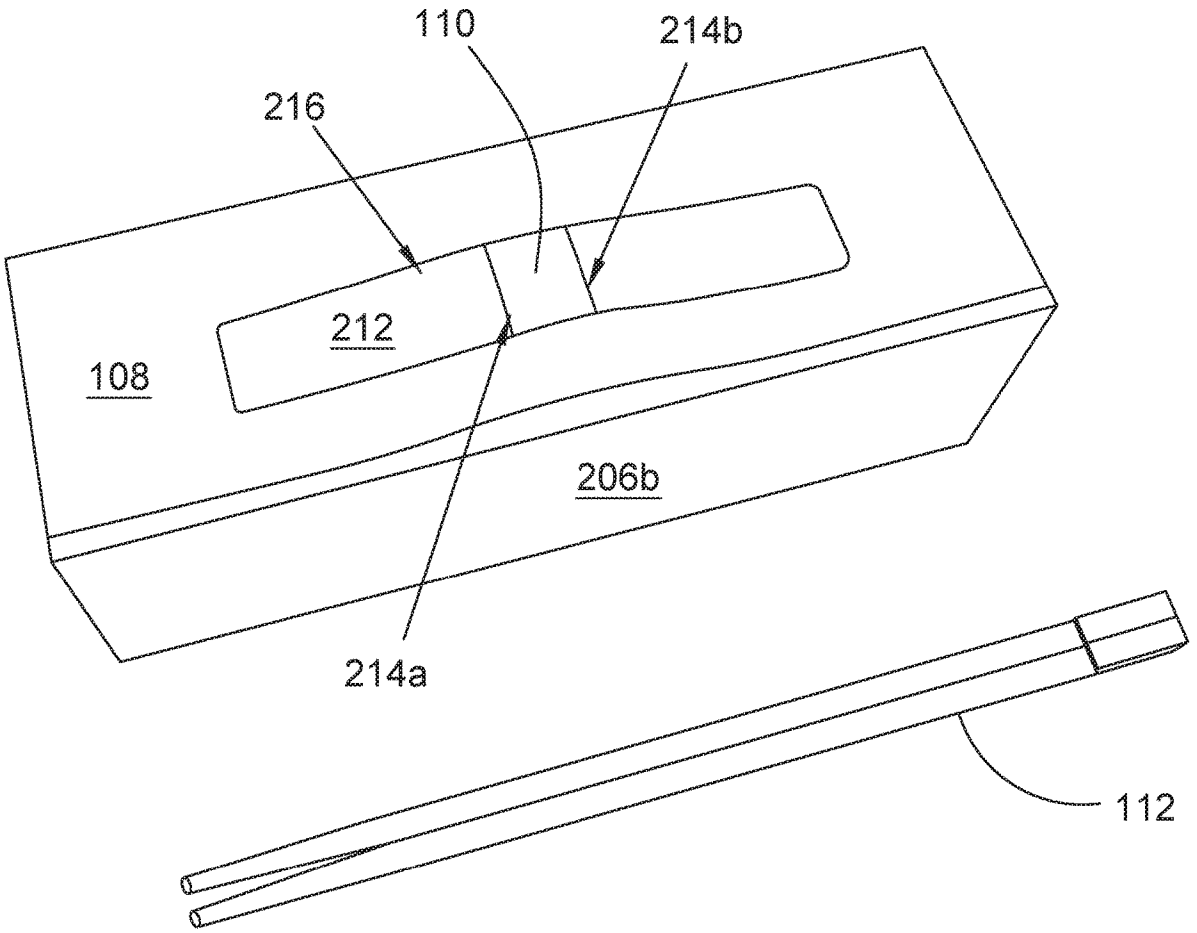
FIG. 7 is a top perspective view of the unitary body folded to form a takeout box configuration, showing an exemplary utensil removed from the loop in the upper face, in accordance with the present invention.
Figure 8:
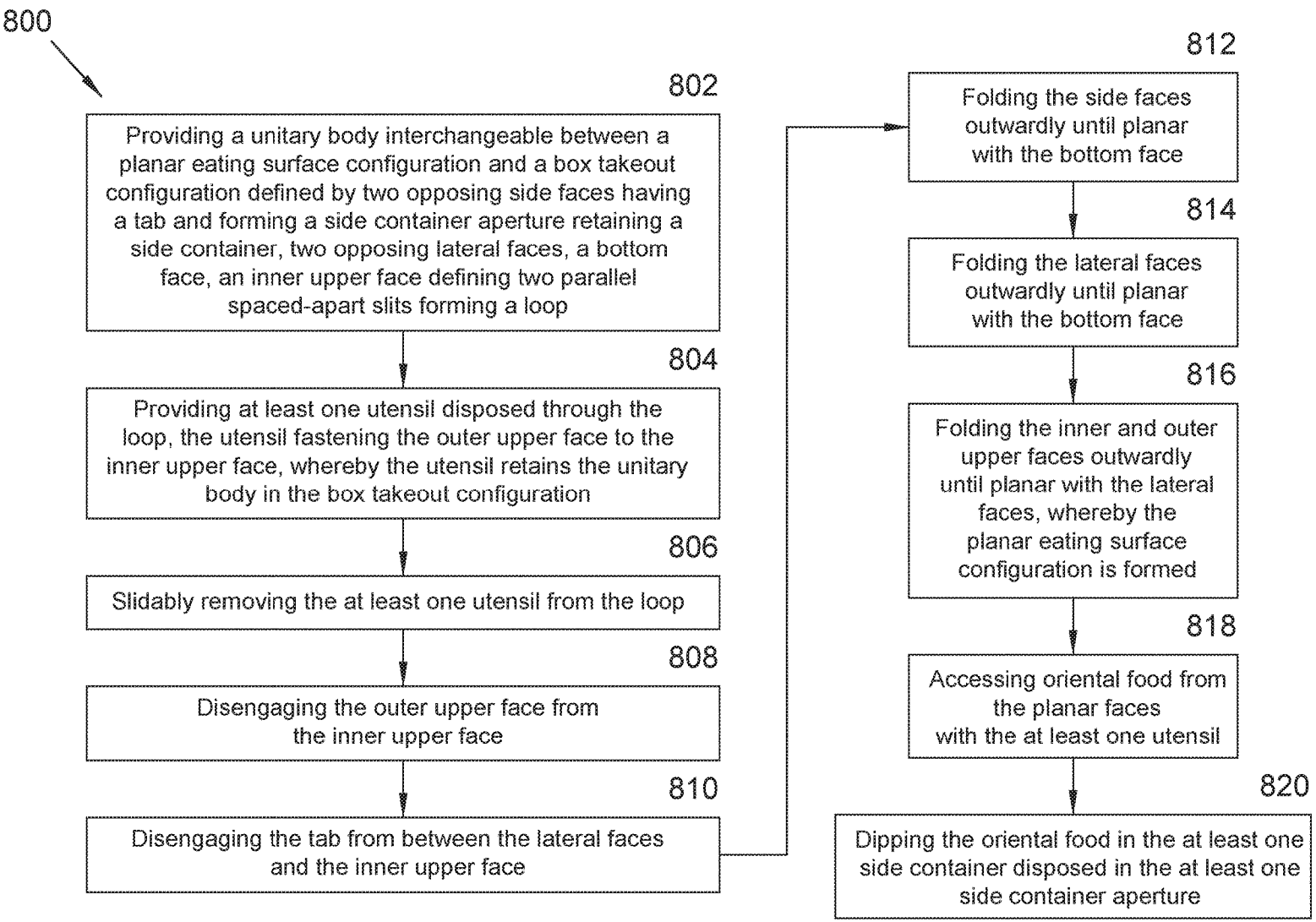
FIG. 8 is a flowchart of an exemplary method for folding an oriental food takeout box and plate assembly between a takeout box configuration and a substantially planar eating surface configuration, in accordance with the present invention.

FIGS. 1-7 will be described in conjunction with the exemplary process flow chart of FIG. 8 and an unfolding path illustrated in FIGS. 9-12. Although FIG. 8 shows a specific order of executing the process steps, the order of executing the steps may be changed relative to the order shown in certain embodiments. Also, two or more steps shown in succession may be executed concurrently or with partial concurrence in some embodiments. Certain steps may also be omitted in FIG. 8 for the sake of brevity. In some embodiments, some or all process steps included in FIG. 8 can be combined into a single process.

The takeout box and plate assembly 100 overcomes known disadvantages of those known devices and methods of this general type and effectively and efficiently stores and transports edible items, such as oriental food. Specifically, one principal objective of the present invention is to create a takeout box that makes carrying the oriental food, sushi, condiments, e.g., soy sauce, and utensils, e.g., chopsticks, easier and more economical; and then follows a simple unfolding path to transform into a eating surface configuration, e.g. plate, from which the oriental food can be consumed upon, accessed with the utensil 112, and immersed in a condiment contained in at least one side container 114*a-b* that detachably couples to the assembly 100.

The oriental food takeout box and plate assembly 100 hereafter "assembly 100" provides a semi-rigid unitary body 102 that serves as a template. The template of the unitary body 102 is foldable along a folding and unfolding path, between a takeout box configuration 104 used for containing and carrying the oriental food, and a planar eating surface configuration 400 useful for consuming oriental food. This semi-rigid construction of the unitary body 102 provides sufficient rigidity to contain, enable consumption, and simplify handling of oriental food and heat/steam generated by the food.

The unitary body 102 is also constructed to retain at least one utensil 112 as a fastener for the unitary body 102 and as a traditional eating instrument, and detachably couple with at least one side container 114*a-b* containing a condiment. Other dual purpose fastening means that help retain the unitary body in the takeout box configuration 104, may include two tabs 402*a-b*, at least one side container 114*a-b*, and interconnecting wings 404-*ab*, 406*a-b*.

FIG. 1 illustrates the unitary body 102 folded into the takeout box configuration 104, e.g., a box-like structure. The unitary body 102 is shown being handled while containing an oriental food, at least one utensil 112, and at least one side container 114*a*, 114*b*. From the takeout box configuration 104, the unitary body 102 can serve as a takeout box, a delivery container, and even a kitchen storage box for oriental food and edible items associated with oriental food. As shown, the unitary body 102 is an oblong, box-like structure having a semi-rigid construction and sufficiently sterile to contain and support oriental food for consumption. The unitary body 102 is also sufficiently rigid to remain firm when the food is steaming, hot, wet, or exhibiting other characteristics that are known in the art to disintegrate food consumption containers.

Also depicted in the illustration is at least one utensil 112, e.g. chopstick, passing through a loop 110 that forms in an outer upper face 108 that defines the unitary body 102. The utensil 112 serves the dual purpose of securely fastening the unitary body 102 in the takeout box configuration 104, and accessing the oriental food while consuming from the planar eating surface configuration 400 of the unitary body 102.

Also depicted in the illustration is at least one side container 114*a*, 114*b* that securely couples to a pair of opposing side faces 200*a*, 200*b* that define the unitary body 102. The side container 114*a-b* serves the dual purpose of containing a condiment that flavors the oriental food during consumption on the eating surface configuration 400, and also providing lateral support to the unitary body 102 while in the eating surface configuration 400.

Figure 2:
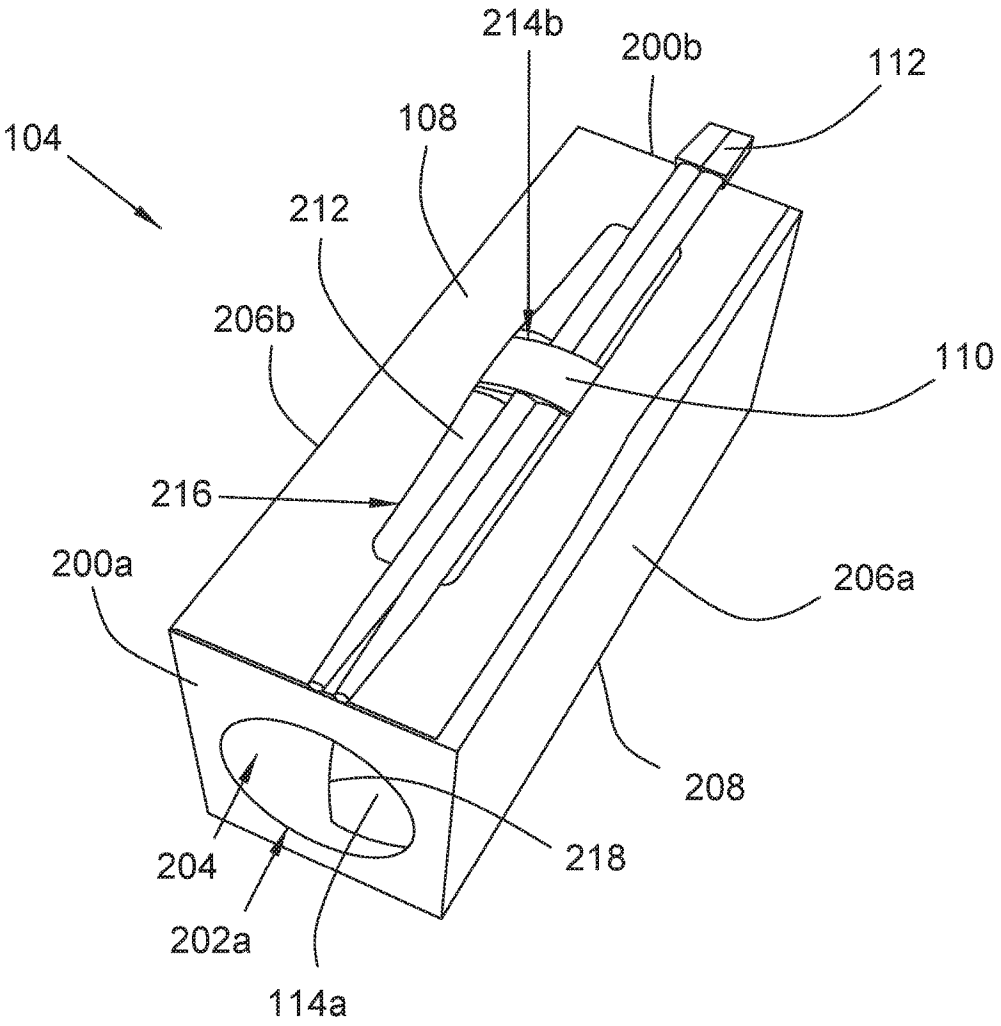
FIG. 2 is a left end perspective view of an exemplary unitary body folded to form a takeout box configuration, in accordance with the present invention.
Figure 3:
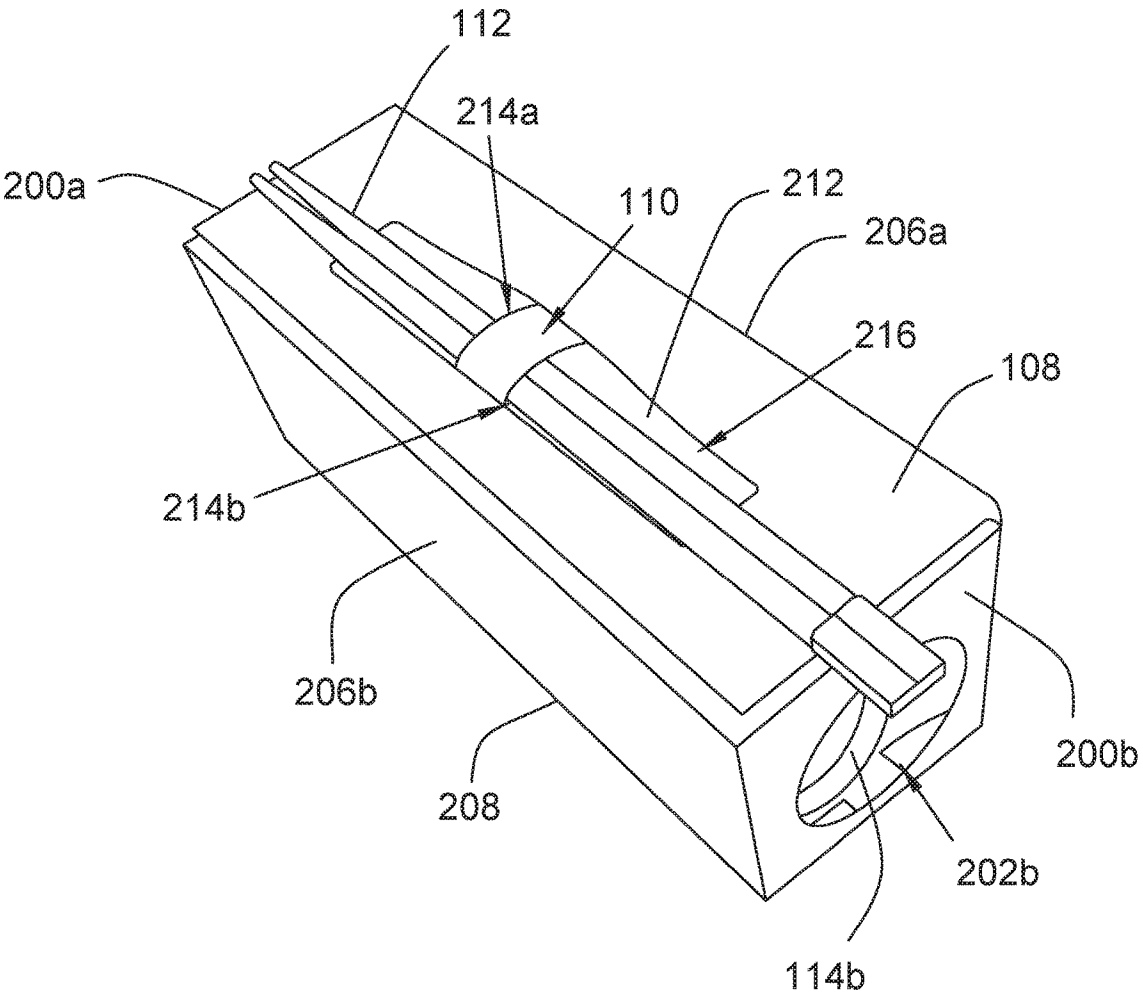
FIG. 3 is a right end perspective view of an exemplary unitary body folded to form the takeout box configuration, in accordance with the present invention.

FIGS. 2 and 3 depict upper angle perspective views of the left and right ends of the unitary body 102 in the takeout box configuration 104. In one non-limiting embodiment, the takeout box configuration 104 comprises a box having a generally oblong shape and a cavity 204 that is sized and dimensioned to contain oriental food, or other edible items. The oblong shape may be defined as deviating from a square, circular, or spherical form by elongation in one dimension.

In this takeout box configuration 104, the unitary body 102 is beneficially capable of being constructed from a single unitary body 102 of material, e.g., card board or wax paper. The takeout box configuration 104 is also beneficially portable and hand-held. In other embodiments, the takeout box configuration 104 may be constructed from multiple constituent parts coupled together using, for example, adhesive. However, the unitary body 102 may also be fabricated from other materials, e.g., other paper- or fabric-based materials such as paperboard or fiberboard, polymeric materials such as PVC or Styrofoam, thin metallic materials.

Figure 4:
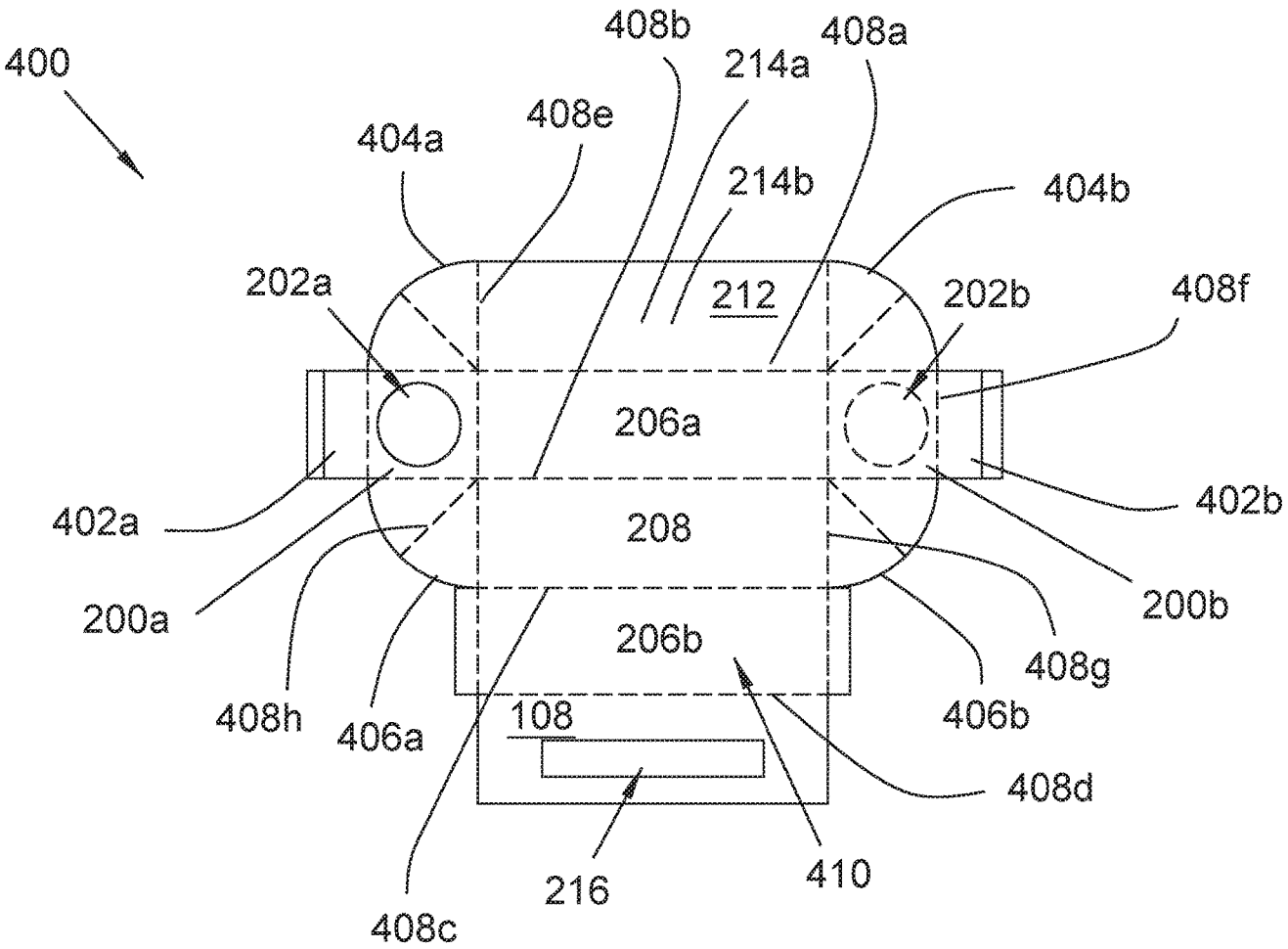
FIG. 4 is a top diagram view of the unitary body unfolded to form the eating surface configuration, in accordance with the present invention.

Preferably, a unitary piece of material is cut using a die press manufacturing method into the dimension depicted in FIG. 4. The die press may also impress partition or at least one perforated line 408*a-h* on and between the faces 108, 200*a-b*, 206*a-b*, 208, 212, 404*a-b*, 406*a-b* that make up the material makeup of the unitary body 102 to facilitate in forming the unitary body 102 into an oblong, or rectangular, box for carrying oriental food, sushi, or other similar food items of similar dimension and purpose (shown best in FIG. 2).

In one embodiment, the unitary and substantially planar box-forming template is formed by a manufacturer and shipped to an end-user and/or food retailer for formation/assembly 100. To form the box-like structure, which is typically of a rectangular shape, but may be formed in other shapes, the user, food retailer, or manufacturer folds the template of the unitary body along the indicia or at least one perforated line 408*a-h* on the template. In one embodiment, to assist in keeping the template in the box-like shape, one or more adhesive strips may be utilized, whereby the adhesive strips provide minimal resistance to tension forces, e.g., less than approximately 1 lbf.

FIG. 4 references a top view of the unitary body 102 in a planar eating surface configuration 400. In this arrangement, the unitary body 102 lies in a flat, open position, operable to enable support and consumption of oriental food and other edible items. From the planar eating surface configuration 400, the inner surface 410 of the unitary body 102 provides a sterile, smooth surface for presentation and consumption of oriental food. In one non-limiting embodiment, when unfolded along the unfolding path to form the eating surface configuration 400, the inner surface 410 of the unitary body 102 serves as an elongated plate. Further, the oriental food may be accessed from the inner surface 410 with the utensil 112, and/or dipped in the condiment contained in the removable side container 114*a-b*.

Continuing with FIG. 4, the unitary body 102 is defined by two opposing side faces 200*a-b* that form the terminus of the unitary body 102. The side faces 200*a-b* form at least one side container aperture 202*a*, 202*b*. In one non-limiting embodiment, the side container aperture 202*a-b* is defined by a circular shape, effective for retaining at least one side container 114*a-b*. The side container 114*a-b* is configured to contain a condiment used to flavor the oriental food. The condiment may include, without limitation, soy sauce, hot sauce, ketchup, olive oil, spices, salt, pepper, and vinegar.

Figure 5:
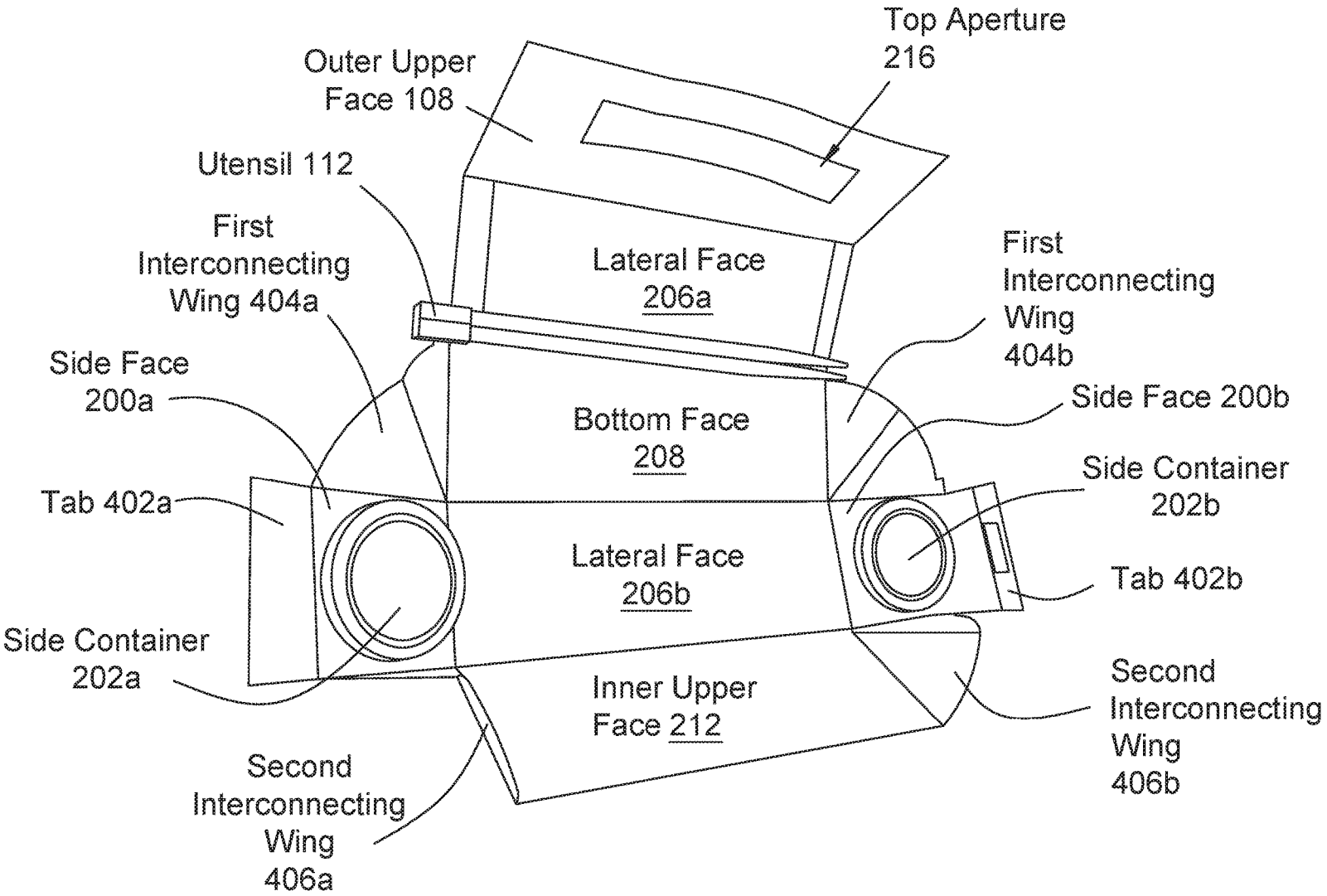
FIG. 5 is an upper angle perspective view of the unitary body unfolded to form the eating surface configuration, in accordance with the present invention.

Specifically, with reference to FIG. 5, the unitary body 102 is defined two circular side container apertures 202*a-b* formed on each side face 200*a*, 200*b*. The side container apertures 202*a-b* may be shaped and sized to receive a portion of a side container 114*a-b*, preferably of a polymeric material. In this manner, when the takeout box configuration 104 is formed, the two side container apertures 202*a-b* are disposed on opposing side faces 200*a-b* of the unitary body 102.

The removable side container 114*a-b* may be used to house, for example, condiments, such as soy sauce. In one embodiment, the perimeter of the material forming the side container apertures 202*a-b* is sized to frictionally retain the one or more side container 114*a-b*(s). Further, the side container 114*a-b*, being disposed on the side faces 200*a-b*, provides lateral stability to the unitary body while in the eating surface configuration 400. However in other embodiments, only one or no side container apertures may be formed.

As such, when the unitary body 102 is folded into the takeout box configuration 104, the side container apertures 202*a-b* may safely and effectively retain the side containers 114*a-b* for later use by the end user. When unfolded along an unfolding path and placed in the eating surface configuration 400, the unitary body 102 serves as a plate for the oriental food, and the circular side container apertures 202*a-b* act as a support for the one or more removable side containers 114*a-b*.

Looking again at FIG. 4, two tabs 402*a*, 402*b* extend from the opposing side faces 200*a-b*. In one non-limiting embodiment, each tab 402*a-b* is configured into a square shape that extends coplanar to a corresponding side face 200*a-b*. When folded into the takeout box configuration, the tabs 402*a-b* fold inwardly to position between the lateral faces 206*a*, 206*b* and the inner upper face 212. In this manner, the tabs 402*a-b*, along with the utensil 112, help to securely fasten and retain the unitary body 102 in the takeout box configuration 104. When unfolded to the eating surface configuration 400, the tabs 402*a-b* provide additional surface area for placing and consuming the oriental food.

The unitary body 102 also includes two opposing lateral faces 206*a-b* adjacent to the side faces 200*a-b*. One of the lateral faces 206*a* lies in longitudinal alignment with the side faces 200*a-b* (FIG. 4). The unitary body 102 further includes a bottom face 208 that is disposed, generally as the central region of the unitary body 102 from the eating surface configuration 400. As shown in FIG. 6, the bottom face 208 is adjacent to the lateral faces 206*a-b* and the side faces 200*a-b* while folded in the takeout box configuration 104.

In some embodiments, the unitary body 102 comprises a second pair of interconnecting wings 406*a*, 406*b* that form a bridge between the side faces 200*a-b* and one of the lateral faces 206*a* of the unitary body 102. Each interconnecting wing 406*a-b* has a generally arc-shape when fully extended in the eating surface configuration 400, and a perforated line 408*h* that allows the wings 406*a-b* to fold in half in the takeout box configuration 104. The second pair of interconnecting wings are designed to increase the surface area of the unitary body 102 when in the eating surface configuration 400. When folded to the takeout box configuration 104, the second pair of interconnecting wings 406*a-b* enhance structural integrity by creating a snug fit between the side faces 200*a-b* and the lateral face 206*a*. This bridge-like structure helps retain the unitary body 102 in the takeout box configuration 104.

The unitary body 102 may also be defined by an inner upper face 212. From the takeout box configuration 104, the inner upper face 212 positions opposite the enclosed bottom face 208. Further, the inner upper face 212 is disposed parallel to an outer upper face 108, discussed below. The inner upper face 212 is disposed more proximal to the bottom face 208 than the outer upper face 108. The inner upper face 212 is defined by two parallel, spaced-apart slits 214*a*, 214*b* that form a loop 110. The loop 110 is configured to receive and retain at least one utensil 112.

Furthermore, the unitary body 102 is defined by an outer upper face 108 that defines and encloses a loop aperture 216. In the takeout box configuration 104, the outer upper face 108 folds to overlay the inner upper face 212. In this manner, the loop 110 protrudes through the loop aperture 216. In one non-limiting embodiment, the loop aperture 216 is defined by a rectangular shape. Though in other embodiments, the loop aperture 216 may have other shapes that enable passage of the loop 110.

With reference to FIG. 2, the slits 214*a*, 214*b* are formed in the inner upper face 212 of the unitary body 102. As best seen in FIG. 3, when formed into the takeout box configuration 104, the outer upper face 108 is folded over the inner upper face 212, whereby the enclosed loop aperture 216 provides access to the slits 214*a-b* that form the loop 110. The slits 214*a-b* provide access, for example, to at least one utensil 112, such as a pair of chopsticks, to be inserted therethrough (or in-and-out). The chopsticks beneficially retain the outer upper face 108 to the inner upper face 212 of the unitary body 102 to effectively maintain the takeout box configuration 104 when the oriental food retained therein is displayed and/or transported.

In other embodiments, the at least one utensil 112, or other structures, may be utilized to be inserted through the loop 110 and retain and maintain the unitary body 102 in the takeout box configuration 104. In further embodiments, fasteners, such as snaps and Velcro, may be utilized to retain the shape and integrity of the takeout box configuration 104. As those of skill in the art will appreciate, when the takeout box configuration 104 is desired to be unfolded to the eating surface configuration 400, the utensil 112 is slidably removed and the unitary body 102 and the unfolding path is followed (FIGS. 9-12) to unfold the unitary body 102 to the planar eating surface configuration 400.

In some embodiments, the unitary body 102 comprises a first pair of interconnecting wings 404*a*, 404*b* that form a bridge between the side faces 200*a-b* and the inner upper face 212 of the unitary body 102. Each interconnecting wing 404*a-b* has a generally arc-shape when fully extended in the eating surface configuration 400, and a perforated line that allows the wings 404*a-b* to fold in half when arranged in the takeout box configuration 104.

The first pair of interconnecting wings 404*a-b* are designed to increase the surface area of the unitary body 102 when in the eating surface configuration 400. When folded to the takeout box configuration 104, the first pair of interconnecting wings 404*a-b* enhance structural integrity of the unitary body 102 by creating a snug fit between the side faces 200*a-b* and the inner upper face 212. This bridge-like structure helps retain the unitary body 102 in the takeout box configuration 104.

In one non-limiting embodiment, at least one perforated line 408*a-h* is disposed between the faces 108, 200*a-b*, 206*a-b*, 208, 212, 404*a-b*, 406*a-b*, so as to provide guidance for following the unfolding path. The perforated lines 408*a-h* also serve to create a visual guide to help in following the unfolding path. The perforated line 408*a-h* also forms a weak point that facilitates folding and unfolding the faces to the desired configuration.

For example, as FIG. 4 illustrates, a first perforated line 408*a* extends between one of the lateral faces 206*a-b* and inner upper face 212; a second perforated line 408*b* extends between the lateral face and bottom face 208. a third perforated line 408*c* extends between one of the lateral faces 206*a-b* and inner upper face 212; a fourth perforated line 408*d* extends between the lateral face and the outer upper face 108.

Continuing with the perforated lines, a fifth perforated line 408*e* extends between the first pair of interconnecting wings and the inner upper face 212; a sixth perforated line 408*f* extends between the side face and the tab; a seventh perforated line 408*g* extends between the bottom face 208 and the second pair of interconnecting wings; and an eighth perforated line 408*h* extends through the second pair of interconnecting wings to enable folding in half.

Looking back at FIG. 2, at least one utensil 112 is disposed through the loop 110 in the outer upper face 108, and directly coupled to the outer surface 106 of the unitary body 102. By passing through the loop 110, the utensil 112 fastens the outer upper face 108 to the inner upper face 212, so as to retain the unitary body 102 in the takeout box configuration 104. As FIG. 7 shows, when the utensil 112 is slidably removed from the loop 110, the unitary body 102 is released to follow the unfolding path; and thereby form the eating surface configuration 400. In some embodiments, the utensil 112 may include, without limitation, a pair of chopsticks joined together, a fork, a knife, and a spoon.

Further, at least one side container aperture 202*a-b* forms in the side faces 200*a-b*. The side container aperture 202*a*, 202*b* serves to retain at least one side container 114*a-b* that contains a condiment. In some embodiments, the side container 114*a-b* may include a cylindrical container that is sized and dimensioned to snugly fit inside the side container aperture 202*a-b* forming in the side faces 200*a-b*. In one non-limiting embodiment, the side container 114*a-b* tapers in diameter to a distal end 218; with the distal end 218 of the side container 114*a-b* passing through the side container aperture 202*a-b* and retained by, and coupled to, each respective side face 200*a-b*.

In accordance with the present invention, the flowchart in FIG. 8 references a method 800 for folding an oriental food takeout box and plate assembly between a takeout box configuration and a substantially planar eating surface configuration.

The method 800 may include an initial Step 802 of providing a unitary body 102 being interchangeable between a planar eating surface configuration 400 and a takeout box configuration 104, the takeout box configuration 104 defined by two opposing side faces 200*a-b* with each side face having a tab extending therefrom and forming at least one side container aperture 202*a-b* retaining at least one side container 114*a-b*, two opposing lateral faces 206*a-b*, an enclosed bottom face 208, an inner upper face 212 opposing the enclosed bottom face 208 and defining two parallel spaced-apart slits 214*a-b* forming a loop 110.

Figure 10:
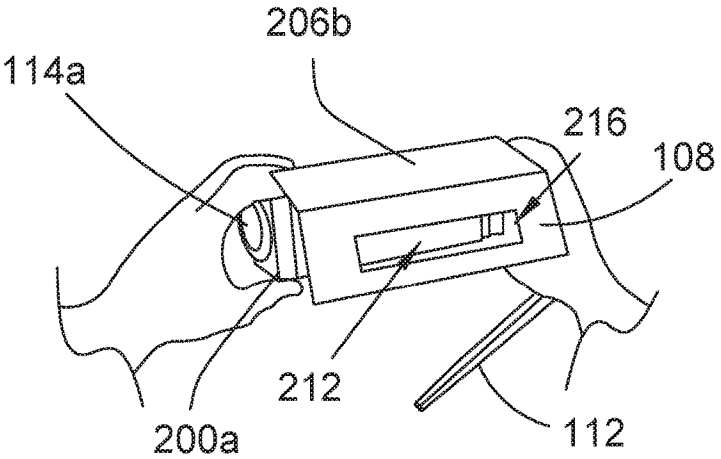
FIG. 10 is a perspective view of a step for disengaging the outer upper face from the inner upper face in the unfolding path, in accordance with the present invention.
Figure 9:
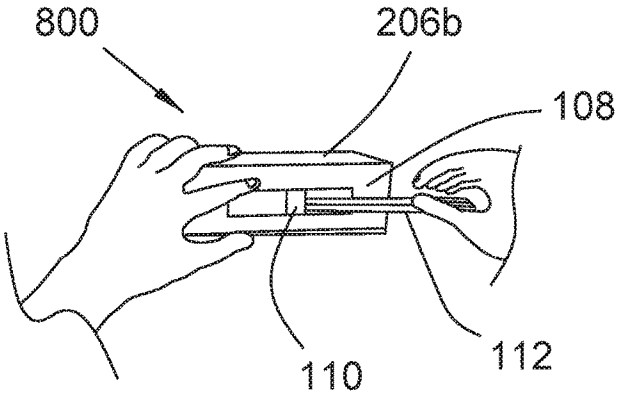
FIG. 9 is a perspective view of a step for slidably removing the utensil from the loop, in accordance with the present invention.

The method 800 may further comprise a Step 804 of providing at least one utensil 112 disposed through the loop 110, the utensil 112 fastening the outer upper face 108 to the inner upper face 212, whereby the utensil 112 retains the unitary body 102 in the takeout box configuration 104. As illustrated in FIG. 9, the method includes a Step 806 of slidably removing the at least one utensil 112 from the loop 110. In some embodiments, a Step 808 comprises disengaging the outer upper face 108 from the inner upper face 212 (FIG. 10). A Step 810 includes disengaging the tab from between the lateral faces 206*a-b* and the inner upper face 212.

Figure 12:
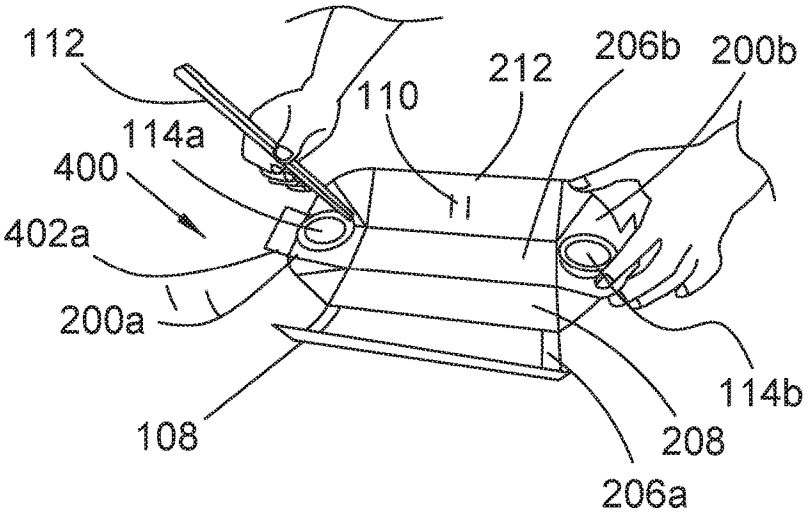
FIG. 12 is a perspective view of a step for accessing oriental food from the planar faces with the at least one utensil, in accordance with the present invention.
Figure 11:
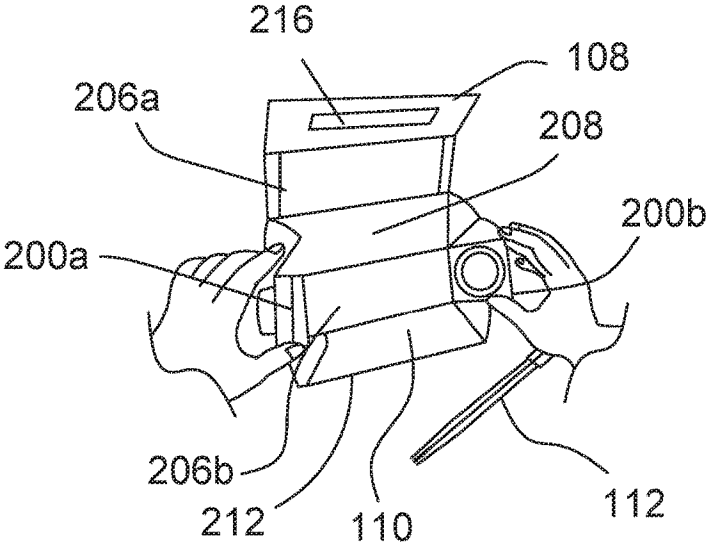
FIG. 11 is a perspective view of a step for folding the side faces outwardly until planar with the bottom face in the unfolding path, in accordance with the present invention.

As depicted in FIG. 11, a Step 812 comprises folding the side faces 200*a-b* outwardly until planar with the bottom face 208. A Step 814 comprises folding the lateral faces 206*a-b* outwardly until planar with the bottom face 208. In some embodiments, a Step 816 may include folding the inner and outer upper face 108*s* outwardly until planar with the lateral faces 206*a-b*, whereby the planar eating surface configuration 400 is formed. As illustrated in FIG. 12, a Step 818 comprises accessing oriental food from the planar faces with the at least one utensil 112. A final Step 820 includes dipping the oriental food in the at least one side container 114*a-b* disposed in the at least one side container aperture 202*a-b*.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence

What is claimed is:

1. An oriental food takeout box and plate assembly, comprising:

a unitary body being interchangeable between a substantially planar eating surface configuration defined by two side faces of the unitary body, two lateral faces of the unitary body, an enclosed bottom face of the unitary body, an inner upper face of the unitary body, and an outer upper face of the unitary body, the inner and upper faces disposed at opposing ends of the unitary body and the two side faces, two lateral faces, enclosed bottom face, inner upper face, and outer upper face defining an inner surface and an outer surface, and a takeout box configuration having:

the two side faces opposing one another with each side face forming at least one side container aperture;

two lateral faces opposing one another, an enclosed bottom face, an inner upper face opposing the enclosed bottom face and defining two parallel spaced-apart discontinuous slits forming a loop, and an outer upper face defining and enclosing a loop aperture with the loop protruding therethrough and above the outer surface of the outer upper face; and the inner and upper faces disposed in an overlapping configuration to define, with the inner surfaces of the two side faces, the two lateral faces, the enclosed bottom face, the inner upper face, and the outer upper face, a cavity for placement of an edible item; and at least one utensil being disposed through the loop and directly coupled to the outer surface of the outer upper face of the unitary body, the utensil fastening the outer upper face to the inner upper face in the overlapping configuration, whereby the utensil retains the unitary body in the takeout box configuration.

2. The oriental food containment assembly according to claim 1, further comprising:

at least one side container tapering in diameter to a distal end, the distal end of the side container disposed through the side container aperture and retained by and coupled to each respective side face.

3. The oriental food containment assembly according to claim 1, further comprising:

two tabs extending from the two opposing side faces.

4. The oriental food containment assembly according to claim 3, wherein:

the tabs fold to position between the lateral faces and the inner upper face when in the takeout box configuration.

5. The oriental food containment assembly according to claim 1, further comprising:

a first pair of interconnecting wings disposed between the side faces and the inner upper face.

6. The oriental food containment assembly according to claim 5, further comprising:

a second pair of interconnecting wings disposed between the side faces and one of the lateral faces.

7. The oriental food containment assembly according to claim 6, wherein:

the interconnecting wings are defined by an arc shape.

8. The oriental food containment assembly according to claim 7, wherein:

the interconnecting wings fold in half when in the takeout box configuration.

9. The oriental food containment assembly according to claim 1, wherein:

the inner upper face is disposed parallel to the outer upper face.

10. The oriental food containment assembly according to claim 9, wherein:

the inner upper face is disposed more proximal to the bottom face than the outer upper face.

11. The oriental food containment assembly according to claim 1, further comprising:

at least one perforated line being disposed between the faces.

12. The oriental food containment assembly according to claim 1, wherein:

the side container aperture is defined by a circular shape.

13. The oriental food containment assembly according to claim 1, wherein:

the loop aperture is defined by a rectangular shape.

14. The oriental food containment assembly according to claim 1, wherein:

the takeout box configuration comprises a box having an oblong shape.

15. The oriental food containment assembly according to claim 1, wherein:

the at least one utensil comprises a chopstick.

16. An oriental food takeout box and plate assembly, comprising:

a unitary body being interchangeable between a substantially planar eating surface configuration defined by two side faces of the unitary body, two lateral faces of the unitary body, an enclosed bottom face of the unitary body, an inner upper face of the unitary body, and an outer upper face of the unitary body, the inner and upper faces disposed at opposing ends of the unitary body and the two side faces, two lateral faces, enclosed bottom face, inner upper face, and outer upper face defining an inner surface and an outer surface and a takeout box configuration having:

the two side faces opposing one another with each side face forming at least one side container aperture;

two lateral faces opposing one another, a bottom face, an inner upper face defining two parallel spaced-apart discontinuous slits forming a loop, and an outer upper face defining and enclosing a loop aperture with the loop protruding therethrough and above the outer surface of the outer upper face; and the inner and upper faces disposed in an overlapping configuration to define, with the inner surfaces of the two side faces, the two lateral faces, the enclosed bottom face, the inner upper face, and the outer upper face, a cavity for placement of an edible item; and at least one perforated line being disposed between the faces;

two tabs extending from the two opposing side faces;

a first pair of interconnecting wings disposed between the side faces and the inner upper face; and a second pair of interconnecting wings disposed between the side faces and one of the lateral faces.

17. The oriental food containment assembly according to claim 16, further comprising:

at least one side container being sized and dimensioned to fit in the at least one side container aperture.

18. The oriental food containment assembly according to claim 16, further comprising:

at least one utensil being sized and dimensioned to pass through the loop at the inner upper face.

19. The oriental food containment assembly according to claim 16, wherein:

the inner surface is configured to support food for consumption.

20. An oriental food takeout box and plate assembly, comprising:

a unitary body being interchangeable between a substantially planar eating surface configuration defined by two side faces of the unitary body, two lateral faces of the unitary body, an enclosed bottom face of the unitary body, an inner upper face of the unitary body, and an outer upper face of the unitary body, the inner and upper faces disposed at opposing ends of the unitary body and the two side faces, two lateral faces, enclosed bottom face, inner upper face, and outer upper face defining an inner surface and an outer surface, and a takeout box configuration having:

the two side faces opposing one another;

two lateral faces opposing one another, an enclosed bottom face, an inner upper face opposing the enclosed bottom face and defining two spaced-apart discontinuous slits forming a loop, and an outer upper face defining and enclosing a loop aperture with the loop protruding therethrough and above the outer surface of the outer upper face; and the inner and upper faces disposed in an overlapping configuration to define, with the inner surfaces of the two side faces, the two lateral faces, the enclosed bottom face, the inner upper face, and the outer upper face, a cavity for placement of an edible item; and at least one utensil being disposed through the loop and directly coupled to the outer surface of the outer upper face of the unitary body, the utensil fastening the outer upper face to the inner upper face in the overlapping configuration, whereby the utensil retains the unitary body in the takeout box configuration.

* * * * *